US009666977B2

(12) United States Patent
Du et al.

(10) Patent No.: US 9,666,977 B2
(45) Date of Patent: May 30, 2017

(54) DIRECT CURRENT SOCKET WITH DIRECT CURRENT ARC PROTECTION

(71) Applicant: ABB Schweiz AG, Baden (CH)

(72) Inventors: Yu Du, Raleigh, NC (US); Emanuele Borla, Cary, NC (US); Rajib Mikail, Raleigh, NC (US); Hongrae Kim, Cary, NC (US); Patrick Schneider, Saint Paul, MN (US)

(73) Assignee: ABB Schweiz AG, Baden (CH)

( * ) Notice: Subject to any disclaimer, the term of this patent is extended or adjusted under 35 U.S.C. 154(b) by 40 days.

(21) Appl. No.: 14/812,648

(22) Filed: Jul. 29, 2015

(65) Prior Publication Data

US 2017/0033495 A1 Feb. 2, 2017

(51) Int. Cl.

| | |
|---|---|
| ***H01R 13/53*** | (2006.01) |
| ***H01F 27/00*** | (2006.01) |
| *H01R 13/66* | (2006.01) |

(52) U.S. Cl.

CPC ..... *H01R 13/53* (2013.01); *H01F 27/00* (2013.01); *H01R 13/6633* (2013.01)

(58) Field of Classification Search

CPC .. H01R 13/53; H01R 13/6485; H01R 12/716; H01R 2103/00; H01R 13/113; H01R 13/112; H01R 12/727; H01R 13/11; H01R 12/58; H01R 12/7088; H01R 13/6666; H01R 13/04; H01R 13/6633; H01F 27/00; H01F 38/22; H01F 38/40

USPC ..... 439/181

See application file for complete search history.

(56) References Cited

U.S. PATENT DOCUMENTS

| | | | | |
|---|---|---|---|---|
| 4,367,448 | A * | 1/1983 | Nishizako | H01H 9/443 218/26 |
| 6,488,549 | B1 | 12/2002 | Weller et al. | |
| 6,756,868 | B2 * | 6/2004 | Sato | H01H 50/38 218/155 |
| 8,134,254 | B2 | 3/2012 | Makwinski | |
| 8,610,313 | B2 | 12/2013 | Makwinski | |

(Continued)

FOREIGN PATENT DOCUMENTS

| | | |
|---|---|---|
| CN | 101789555 A | 7/2010 |
| CN | 101854051 A | 10/2010 |

(Continued)

OTHER PUBLICATIONS

Brian Davies, (Anderson Power Products), "Power inlet connector for 380V DC data center," in 2011 Green Building Power Forum, San Jose, CA, USA, Jan. 24-26, 2011.

(Continued)

*Primary Examiner* — Xuong Chung Trans

(74) *Attorney, Agent, or Firm* — Barnes & Thornburg LLP

(57) ABSTRACT

Technologies for providing DC arc protection in a DC socket include an electromagnet positioned in the DC socket configured to produce a magnetic field. The electromagnet is positioned to be adjacent to a contact region between one or more supply terminals of a DC socket and one or more prongs of a DC plug. As the DC plug is disconnected from the DC socket, a DC arc might form between one or more of the supply terminals and one or more of the prongs. The magnetic field produced by the electromagnet reduces the energy of the DC arc and reduces the time duration of the DC arc.

21 Claims, 6 Drawing Sheets

(56) References Cited

U.S. PATENT DOCUMENTS

| | | | | |
|---|---|---|---|---|
| 8,890,371 | B2 | 11/2014 | Gotou | |
| 9,336,975 | B2 * | 5/2016 | Iizuka | H01H 47/00 |
| 9,373,468 | B2 * | 6/2016 | Priest | H01H 33/182 |
| 2003/0027447 | A1 | 2/2003 | Cooper et al. | |
| 2011/0122663 | A1 | 5/2011 | Huang | |
| 2011/0124218 | A1 | 5/2011 | Huang et al. | |
| 2012/0050928 | A1 | 3/2012 | Johnson, Jr. | |
| 2012/0200280 | A1 | 8/2012 | Jin et al. | |

FOREIGN PATENT DOCUMENTS

| | | | |
|---|---|---|---|
| CN | 201766190 | U | 3/2011 |
| CN | 201805036 | U | 4/2011 |
| CN | 102496505 | A | 6/2012 |
| DE | 10225259 | B3 | 1/2004 |
| DE | 102011109920 | A1 | 2/2013 |
| EP | 1286429 | A2 | 2/2003 |
| EP | 2161793 | A1 | 3/2010 |
| EP | 2251941 | A1 | 11/2010 |
| EP | 2551967 | A1 | 1/2013 |
| JP | 03274688 | A | 12/1997 |
| JP | 2004158331 | A | 6/2004 |
| JP | 2004158332 | A | 6/2004 |
| JP | 2005108451 | A | 4/2005 |
| JP | 2005294077 | A | 10/2005 |
| JP | 2009146777 | A | 7/2009 |
| JP | 2009146778 | A | 7/2009 |
| JP | 2009146779 | A | 7/2009 |
| JP | 2009146780 | A | 7/2009 |
| JP | 2009146781 | A | 7/2009 |
| JP | 2009146782 | A | 7/2009 |
| JP | 2009146783 | A | 7/2009 |
| JP | 2010213479 | A | 9/2010 |
| JP | 2011003409 | A | 1/2011 |
| JP | 2011034687 | A | 2/2011 |
| JP | 2011124098 | A | 6/2011 |
| JP | 2011142768 | A | 7/2011 |
| JP | 2011146328 | A | 7/2011 |
| JP | 2011258511 | A | 12/2011 |
| JP | 2012119105 | A | 6/2012 |
| JP | 2012119106 | A | 6/2012 |
| JP | 2012209210 | A | 10/2012 |
| WO | 2010147008 | A1 | 12/2010 |
| WO | 2012035387 | A1 | 3/2012 |
| WO | 2012038797 | A1 | 3/2012 |
| WO | 2012063528 | A1 | 3/2012 |

OTHER PUBLICATIONS

Baek et al., "Development of plug and socket-outlet for 400 volts direct current distribution system", 8th International Conference on Power Electronics—ECCE Asia, May 30, 2011, 5 pages.

Iino et al., "Development of 400 Vdc Plug and Socket-Outlet for DC Distribution System" 2012 IEEE, 6 pages.

Techakittiroj, "Electrical Plug and Outlet for the DC Distribution System in Buildings", International Conference on Control, Automation and Systems 2008, Oct. 14-17, 2008, 4 pages.

Robert Cid, (Tyco Electronics), "Arc-suppressed connectors for HVdc Applications," in 2011 Green Building Power Forum, San Jose, CA, USA, Jan. 24-26, 2011.

Mattavelli et al., (Center for Power Electronic Systems, Virginia Tech), "DC power systems for sustainable buildings," 2011 Green Building Power Forum, San Jose, CA, USA, Jan. 24-26, 2011.

Greenbuilding Power Forum, EMerge Alliance, San Jose, CA, USA, Jan. 24-26, 2011, 117 pages.

* cited by examiner

DIRECT CURRENT SOCKET WITH DIRECT CURRENT ARC PROTECTION

BACKGROUND

Low voltage direct current (LVDC) distribution systems are emerging in a number of industrial, commercial, and residential applications. Typically LVDC distribution systems involve the use of many power electronic converters on either the distributed power generation or the electric and electronics load side. An example of industrial LVDC distribution systems is the DC data center. In traditional AC data centers, multiple power conversion stages are required to convert utility AC power to DC load power and to ensure that the power supplied to the servers is not interrupted with battery energy storage. By using a LVDC distribution system some DC data centers have been able to eliminate up to two power conversion stages, improving the energy conversion efficiency of the power distribution system.

For residential and commercial settings, another example of LVDC distribution is a local DC grid connecting DC photovoltaic power generation systems, battery energy storage systems, plug-in electric vehicles, and DC electronics and appliances. Traditionally, photovoltaic cells in photovoltaic power generation systems produce DC power that must be converted to AC power before being distributed across the electrical grid. Batteries supply the electricity to fuel electric vehicles in on-board energy storage applications, or provide the backup power and the load peak shaving/shifting services in stationary storage applications. Consequently, batteries are charged with DC power but need additional AC/DC converters in an AC grid system. Other consumer appliances and electronics (e.g., televisions, computers, monitors, printers, and LED lighting) use DC power and require conversion of the AC power delivered by the traditional AC power distribution system to DC power to function properly. The local DC grid enables the direct use of photovoltaic power with better efficiency and minimal power conversion hardware. The DC plug and socket outlet device connects the equipment, appliances or electronics to the LVDC distribution system and delivers the power for end use.

SUMMARY

Accordingly to one aspect, a direct current (DC) socket for reducing DC arcing may include a receptacle configured to receive one or more prongs of a DC plug of an electrical device. The receptacle includes one or more supply terminals to supply a DC power from a DC power source to the electrical device via the DC plug. Each of the supply terminals is configured to contact a corresponding prong of the DC plug within a contact region of the receptacle while the DC plug is connected to the DC socket, and an electromagnet positioned in the receptacle and configured to produce a magnetic field within the contact region of the receptacle to reduce a DC arc generated between the supply terminals and the prongs in response to disconnection of the DC plug from the DC socket.

In some embodiments, the electromagnet is configured to produce the magnetic field in response to contact between the one or more prongs of the DC plug and the supply terminals of the receptacle. The magnetic field produced by the electromagnet is proportional to a load current supplied to the electrical device by the DC socket.

In some embodiments, the electromagnet may include a core made of a ferromagnetic material, and one or more coils positioned on the core configured to generate the magnetic field in response to a coil current.

In some embodiments, the core may include a base having a first end and a second end, a first column extending from the first end of the base, a second column extending from the second end of the base parallel to the first column, and a central column extending from the base parallel to the first column and the second column and positioned between the first column and the second column. The first column and the central column define a first gap therebetween and the second column and the central column define a second gap therebetween. In some embodiments, the one or more coils may include a first coil positioned on the first column around a first coil section of the first column and configured to generate a first magnetic field. The first column includes a first exposed section above the first coil section configured to direct the first magnetic field across the first gap to the central column, and a second coil positioned on the second column around a second coil section of the second column and configured to generate a second magnetic field. The second column includes a second exposed section above the second coil section configured to direct the second magnetic field across the second gap to the central column. In some embodiments, the first gap and the second gap are each sized to receive a supply terminal of the one or more supply terminals coupled to the corresponding prong of the DC plug. In some embodiments, the one or more coils of the electromagnet are electrically coupled in series with the electrical device.

In some embodiments, the core may include a base having a first base end a second base end, a top extending parallel to the base having a first top end a second top end, a central column extending from the base to the top. The central column connects the base to the top between the first and second ends of the base and the first and second ends of the top. The top further includes a first top column extending toward the base at the first top end, and the base includes a first base column extending towards the top at the first base end. The top further includes a second top column extending toward the base at the second top end, and the base includes a second base column extending toward the top at the second base end. In some embodiments, the one or more coils may include a single coil configured to generate the magnetic field. The single coil is positioned on the central column and extends from the base to the top. The first top column and the first base column cooperate to define a first gap and the second top column and the second base column cooperate to define a second gap. The first gap and the second gap are each sized to receive a supply terminal of the one or more supply terminals coupled to the corresponding prong of the DC plug. In some embodiments, the first top column and the first base column are configured to cause the magnetic field to pass from the first top column, across the first gap, to the first base column, and the second top column and the second base column are configured to cause the magnetic field to pass from the second top column, across the second gap, to the second base column. In some embodiments, the single coil is electrically coupled in parallel with the DC power source from which the electrical device receives the DC power.

In some embodiments, the DC socket may include an arc chute positioned in the receptacle and configured to redirect the DC arc generated between the supply terminals and the prongs in response to disconnection of the DC plug from the DC socket. The DC socket may include a shutter to selectively prevent access to the supply terminals.

According to another aspect, a method for reducing DC arcing of a DC socket may include delivering, by the DC socket, a DC power to a DC plug of an electrical device connected to the DC socket. Delivering the DC power may include energizing an electromagnet of the DC socket to generate a magnetic field within the DC socket, and reducing, by the generated magnetic field, a DC arc generated within a receptacle of the DC socket in response to disconnection of the DC plug from the DC socket.

In some embodiments, energizing the electromagnet may include energizing the electromagnet with a load current supplied to the electrical device by a DC power source via the DC plug and the DC socket. The electromagnet generates the magnetic field proportional to the load current delivered to the electrical device. Reducing the DC arc within the receptacle of the DC socket may include reducing an energy of the DC arc and reducing a time duration of the DC arc. Energizing the electromagnet of the DC socket may include energizing the electromagnet of the DC socket to generate a time invariant magnetic field. In some embodiments, energizing the electromagnet of the DC socket may include energizing a coil of the electromagnet that is electrically coupled in parallel with a DC power source from which the DC power is received. In some embodiments, energizing the electromagnet of the DC socket may include energizing a coil of the electromagnet that is electrically coupled in series with the electrical device.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 1:
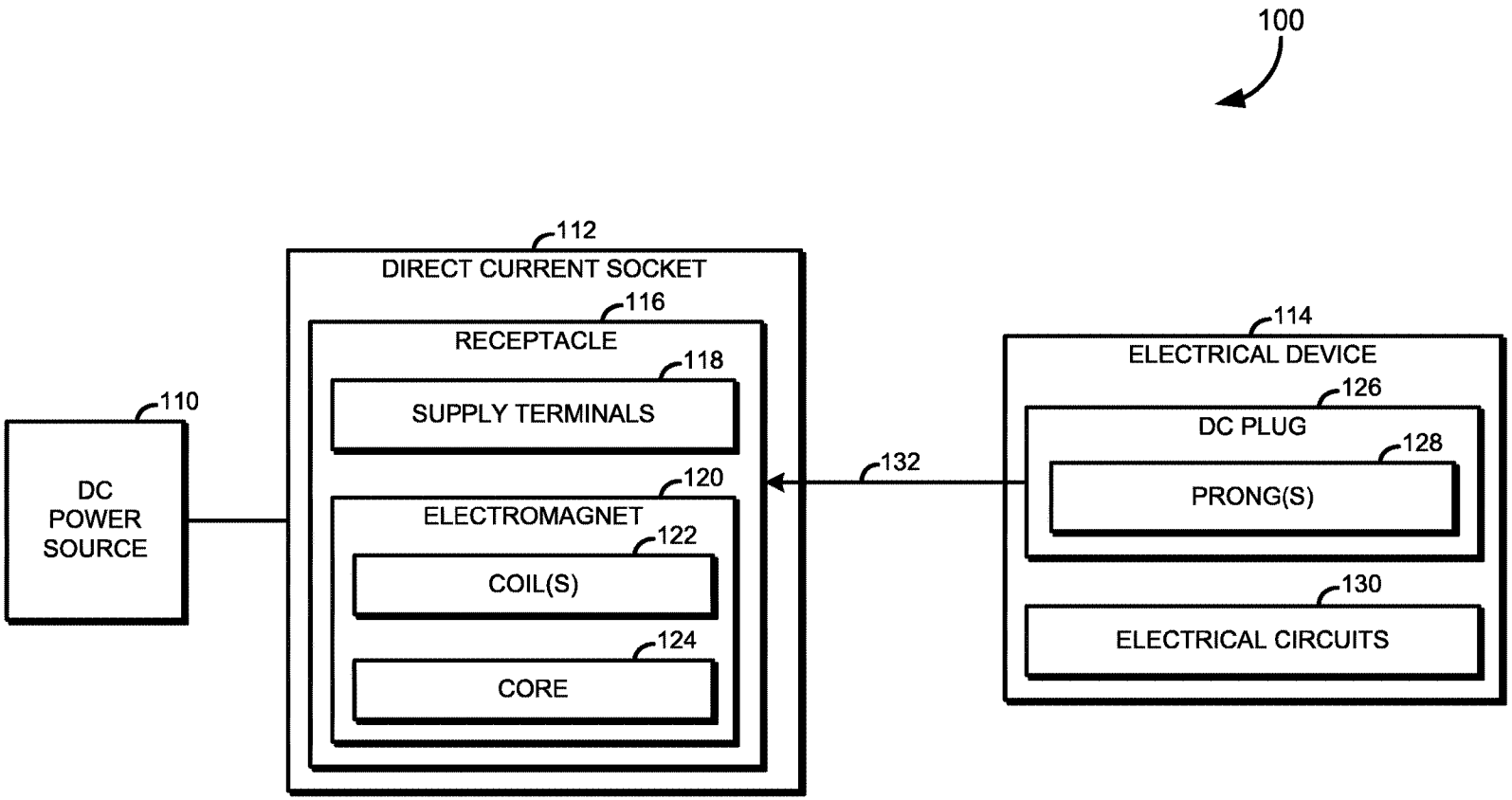
FIG. 1 is a simplified block diagram of at least one embodiment of a DC socket with a DC arc protection system for reducing a direct current arc.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one of A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

The disclosed embodiments may be implemented, in some cases, in hardware, firmware, software, or any combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring now to FIG. 1, in an illustrative embodiment, a system 100 for reducing a direct current (DC) arc includes a power source 110, a DC socket 112, and an electrical device 114. In the illustrative embodiment as discussed in more detail below, the DC socket 112, used in conjunction with a LVDC power distribution system, includes an electromagnet 120 configured to generate a magnetic field in one or more terminal contact regions of the DC socket 112 to reduce any DC arcing that may occur when electrical device is disconnected from the DC socket 112. It should be appreciated that when a DC plug 126 of the electrical device 114 is disconnected from the DC socket 112 of a LVDC power distribution system a DC arc may be generated between one or more prongs 128 of the DC plug 126 and one or more supply terminals 118 of the DC socket 112. DC arcs may generate significant energy and associated heat, which can be more than one kilojoule, and last up to several seconds. Such DC arcs may cause fires, injury to a user of the DC power system, damage to the DC socket 112 and electrical device 114, or reduce the operating life of the electrical components of the DC power distribution system or the electrical device 114 connected to the DC power distribution system. It should be appreciated that there exists a DC socket device to reduce this DC arcing may be desirable. The arcing occurs because there are no zero crossings of voltage and current in DC systems. In addition to quenching a DC arc, the illustrative DC socket should be robust, compact and cost effective, similar to the traditional AC sockets used by consumers.

In general, the magnetic field generated by the electromagnet 120 reduces the DC arc when the one or more prongs 128 separate from the one or more supply terminals 118. As a result, both DC arcing duration time and DC arcing energy may be reduced, and the damage to the electrical contacts and the potential safety hazards due to DC arcing may be mitigated.

The DC power source 110 may be configured as any type of DC power supply capable of energizing one or more DC electrical devices 114. In some embodiments, the DC power source 110 includes an AC-to-DC converter connected to an AC power distribution system (e.g., an AC grid). The DC power source 110 may include any type of energy sources (e.g., generators, fuel cells, or photovoltaic cells), any type of electrical energy transmission systems, and/or any type of energy storage devices such as, for example, batteries or super capacitors.

The DC socket 112 includes a receptacle 116 configured to receive the DC plug 126. The connection and interaction between the DC plug 126 and the DC socket 112 is shown illustrative in FIG. 1 as connection arrow 132. The receptacle 116 includes one or more supply terminals 118 configured to deliver power from the DC power source 110 to the electrical device 114 via the corresponding prongs 128, and an electromagnet 120 configured to generate a magnetic field. In the illustrative embodiment, the electromagnet 120 generates a magnetic field in response to the electrical device 114 being connected to the DC socket 112 (i.e., due to the flow of DC power through the receptacle 116 to the DC plug 126 of the electrical device 114).

In the illustrative embodiment, the receptacle 116 is embodied as a housing having one or more apertures (not shown) in which the supply terminals 118 are positioned. The apertures are sized to receive the one or more prongs 128 of the DC plug 126. In some embodiments, the apertures of the receptacle 116 are configured to maintain the electrical connection between the prongs 128 of the DC plug 126 and the supply terminals 118 of the DC socket 112 by creating an interference fit between the apertures and the prongs 128. Additionally or alternatively, the supply terminals 118 may be formed to receive the prongs 128 and maintain an electrical connection between components through an interference fit. For example, the prongs 128 may be configured as male electrical connectors and the supply terminals 118 may be configured as female electrical connectors or vice versa.

The location of the supply terminals 118 in the receptacle 116 defines one or more contact regions in which the supply terminals 118 and the prongs 128 physically contact each other to form an electrical connection when the DC plug 126 is connected to the receptacle 116 and in which a DC arc may form when the prongs 128 are disconnected from the supply terminals 118. The supply terminals 118 and the prongs 128 may be configured to mate together, couple with each other, or otherwise contact each other in the contact region of the receptacle 116 in any suitable manner. For example, the supply terminals 118 and the prongs 128 may overlap each other, be received by one another, or use some other physical mechanism to ensure electrical contact between each other.

The illustrative receptacle 116 also includes one or more electromagnets 120 configured to produce one or more magnetic fields to reduce DC arcing between the supply terminals 118 and the prongs 128, which may be generated when prongs 128 are disconnected from the supply terminals 118. The electromagnet 120 includes one or more coils 122 and one or more cores 124. In the illustrative embodiment, the electromagnet 120 includes a single core 124, made of a ferromagnetic material such as iron, with one or more coils 122 positioned on the core 124. The one or more coils 122 include electrical wires coiled around the core 124 that form a solenoid coil. The one or more coils 122 are positioned on the core 124 to generate a magnetic field in response to a coil current. The core 124 is configured to concentrate the magnetic field at specific locations and generally strengthen the magnetic field at those locations. In the illustrative embodiments, the electromagnet(s) 120 are configured to produce a magnetic field across one or more gaps formed in the electromagnet core 124, which correspond to the contact region of the receptacle 116 (i.e., the region in which the prongs 128 of the DC plug 126 contact the supply terminals 118). In some embodiments, the electromagnet 120 produces the magnetic field in response to the DC prongs 128 being in contact with the supply terminals 118 of the receptacle 116 such that a DC current flows through the coils 122 of the electromagnet 120.

The electrical device 114 may be configured as any electrical device configured to run on DC power. For example, the electrical device 114 may be embodied as an electric vehicle, a computer, a television, an LED, a DC motor, or other DC-powered device. It may also be embodied as a DC-AC power inverter for an AC-powered device, such as a motor driver. As discussed above, the electrical device 114 includes the DC plug 126 configured to connect to the receptacle 116 of the direct current socket 112. Additionally, the electrical device 114 may include various electrical circuits 130. The electrical circuits 130 of the electrical device 114 may be embodied as any electrical circuitry designed to accomplish the various functions of the electrical device 114. The particular electrical circuits 130 included in the electrical device 114 may depend on the type of electrical device 114 and its intended function. Again, as discussed above, the DC plug 126 includes the one or more prongs 128 configured to interact with the supply terminals 118 of the DC socket 112 and establish an electrical connection to supply DC power to the electrical device 114 from the DC power source 110.

While the illustrative system 100 includes the DC socket 112 incorporated in, or otherwise connected to, the DC power source 110, the DC socket 112 may be incorporated in the electrical device 114 and the DC plug may be connected to or incorporated in the DC power source 110 in other embodiments. For example, an electric vehicle may include a DC socket configured to receive a DC plug associated with a charging station that is connected to the DC power source 110. In such an example, the DC arc reducing system is incorporated into the DC socket included in the electrical device 114 (i.e., the electric vehicle). In some embodiments, the DC socket 112 includes an arc chute. The arc chute may be positioned in the receptacle to be near the one or more contact regions. The arc chute is configured to redirect a DC arc generated between a supply terminal 118 and a DC prong 128 and thereby dissipate the DC arc. In some embodiments, the socket 112 may include a shutter to prevent unwanted access to the supply terminals 118 and thereby prevent the risk of electric shock hazard.

Figure 2:
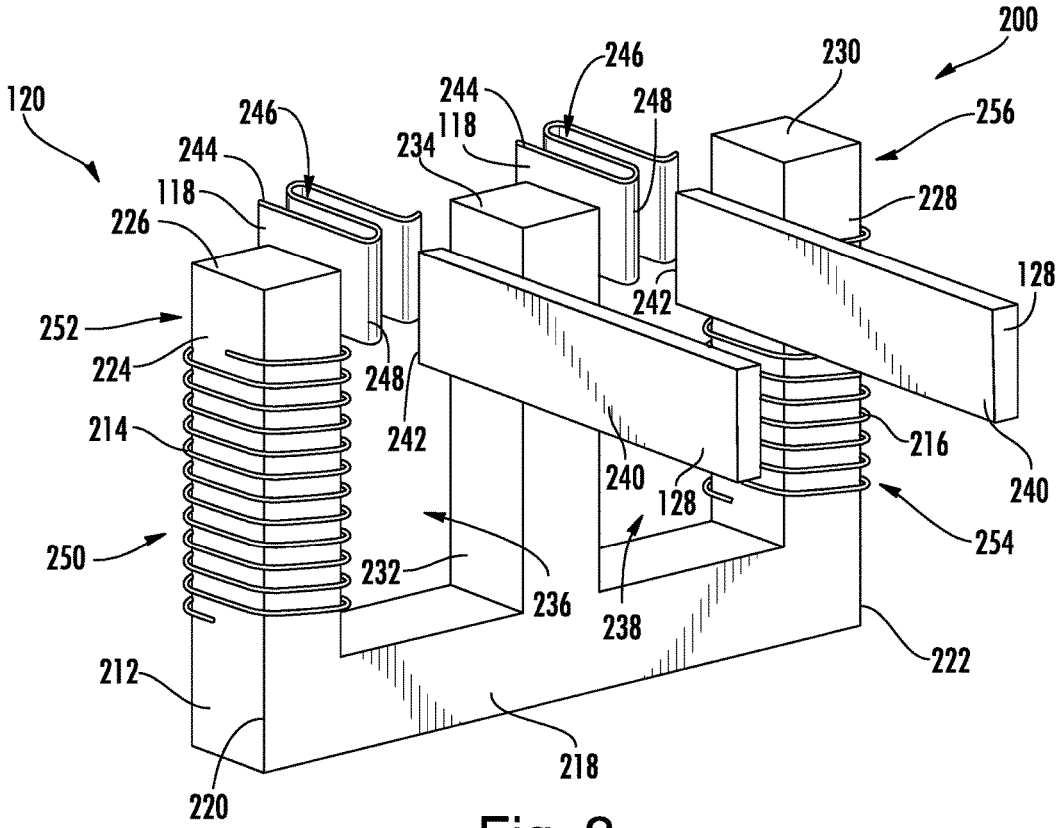
FIG. 2 is a perspective view of an embodiment of the DC arc protection system included in the DC socket of FIG. 1.

Referring now to FIG. 2, an illustrative DC arc protection system 200 of the DC socket 112 is shown. The DC arc protection system 200 includes the electromagnet 120, which illustratively includes a core 212 made of a ferromagnetic material (such as iron) and a first coil 214 and a second coil 216 positioned on the core 212. Both coils 214, 216 are configured to generate a magnetic field in response to a DC coil current. The core 212 includes a base 218 having a first end 220 and second end 222 opposite the first end 220. A first column 224 extends from the base 218 at the first end 220 and terminates at a first top surface 226. A second column 228 extends, parallel to the first column 224, from the base 218 at the second end 222 and terminates at a second top surface 230. A central column 232 is positioned between the columns 224, 228 and extends, parallel to the first column 224 and the second column 228, from the base 218 and terminates in a central top surface 234. The first, second and central top surfaces 226, 230, 234 are approximately the same distance away from the base 218. In the illustrative embodiment, the central column 232 is spaced evenly between the first column 224 and the second column 228.

The first column 224 and the central column 232 are spaced apart from one another and cooperate to define a first gap 236 therebetween. Similarly, the second column 228 and the central column 232 are also spaced apart from one another and cooperate to define a second gap 238 therebetween. In the illustrative embodiment, the first and second gaps 236, 238 are sized to receive both the supply terminals 118 and the prongs 128. In particular, the first and second gaps 236, 238 are sized to receive the supply terminals 118 and the prongs 128 while they are coupled together forming an electrical connection between the DC power source 110 and the electrical device 114. As such, the first and second gaps 236, 238 correspond to the contact region of the DC receptacle 116 in the illustrative embodiment of FIG. 2.

In the illustrative embodiment, each prong 128 is configured to mate with a corresponding supply terminal 118 through an interference fit. Each prong 128 is illustratively formed as a rigid metal blade 240 with a leading edge 242 and each supply terminal 118 is made of a flexible metal beam 244 shaped to receive the corresponding metal blade 240. Each flexible beam 244 is shaped to form a slot 246 configured to receive the metal blade 240 and includes a leading edge 248. When the metal blade 240 is inserted into the slot 246, the flexible beam 244 is configured to exert a pinching force on the metal blade 240. The pinching force maintains the electrical connection between the flexible beam 244 and the blade 240. Of course, other connection mechanisms may be used in other embodiments to electrically connect the prongs 128 and the supply terminals 118.

As shown in FIG. 2, the first coil 214 is positioned on the first column 224 and the second coil 216 is positioned on the second column 228. In the illustrative embodiment, the first and second coils 214, 216 are made of a conductive wire, such as copper wire, and are wrapped around their respective columns 224, 228. The windings of the first coil 214 extend from the base 218 partially up the first column 224 and define a coil section 250 of the first column 224. An exposed section 252 of the first column 224 extends from the top of the coil 214 to the first top surface 226 of the first column 224. Similarly, the windings of the second coil 216 extend from the base 218 partially up the second column 228 and define a coil section 254 of the second column 228. An exposed section 256 of the second column 228 extends from the top of the coil 216 and to the second top surface 230 of the second column 228.

Figure 3:
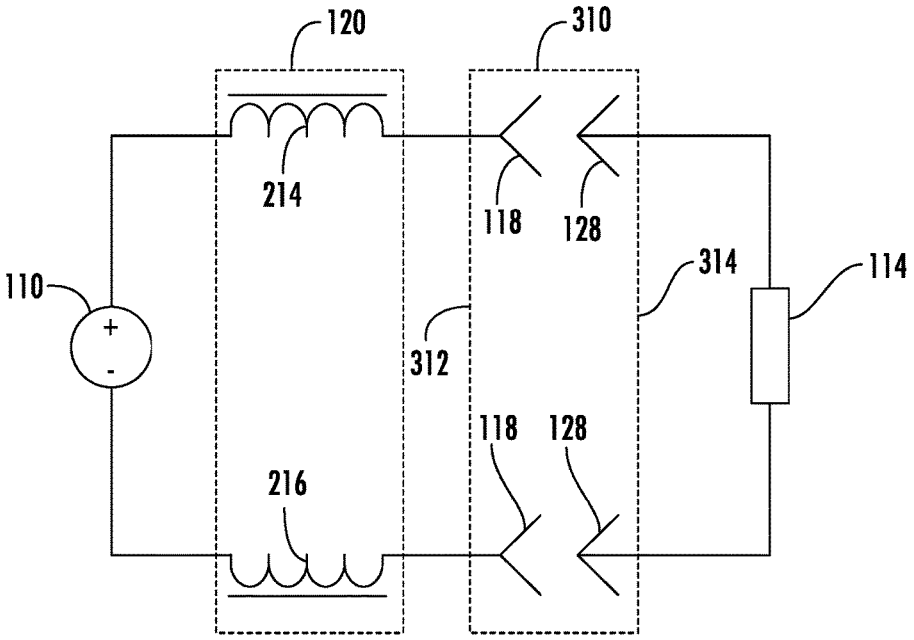
FIG. 3 is a simplified electrical circuit diagram of the DC arc protection system of FIG. 2.

Referring now to FIG. 3, a simplified electrical diagram of the DC arc protection system 200 is shown. In the illustrative embodiment, the DC power source 110 is connected in series with the electrical device 114 and the two coils 214, 216 of the electromagnet 120 when the electrical device 114 is connected to the receptacle 116. The electrical device 114 includes two prongs 128 that are configured to mate with or otherwise contact two corresponding supply terminals 118 in a contact region 310 of the receptacle 116. The contact region 310 corresponds with the gaps 236, 238 of the electromagnet 120 of FIG. 2. As the prongs 128 are removed from the receptacle 116 and out of contact with the supply terminals 118, a DC arc may form between the leading edge 242 of the blade 240 and the leading edge 248 of the flexible beam 244 within the contact region 310 (i.e., within the gaps 236, 238).

In the illustrative embodiment of FIG. 3, each coil 214, 216 of the electromagnet 120 is connected in series between the DC power source 110 and the supply terminals 118 and is configured to generate a magnetic field in response to a DC current flowing therethrough. Because each coil 214, 216 is connected in series between the DC power source 110 and the electrical device 114, a current is only applied to each coil 214, 216 when the electrical device 114 is connected to the DC power source 110 and the resulting circuit is complete. As such, each coil 214, 216 is energized by the load current supplied to the electrical device 114. Consequently, the magnetic field produced by the electromagnet 120 is proportional to the current being drawn by the electrical device 114. In general, the DC arc formed between the prongs 128 and the supply terminals 118 is also proportional to the current being drawn by the electrical device 114. By energizing the electromagnet 120 with the load current, the magnetic fields produced by each coil 214, 216 of the electromagnet 120 are proportional to the strength of the potential DC arc. For example, when the load current is high, the potential strength of the formed DC arc is high, and the magnetic field strength produced by the electromagnet 120 is also high.

Additionally, because the load current is used to excite the electromagnet 120, the generated magnetic field can reduce DC arcs in either direction. For example, for the charging and discharging operation of a residential battery energy storage system, at different times the power flows either out of the socket or back into the socket. When the current direction reverses in the discharging operation, the magnetic field generated by the electromagnet 120 also reverses direction. Therefore, the direction of the force applied to stretch the arc remains the same.

Figure 4:
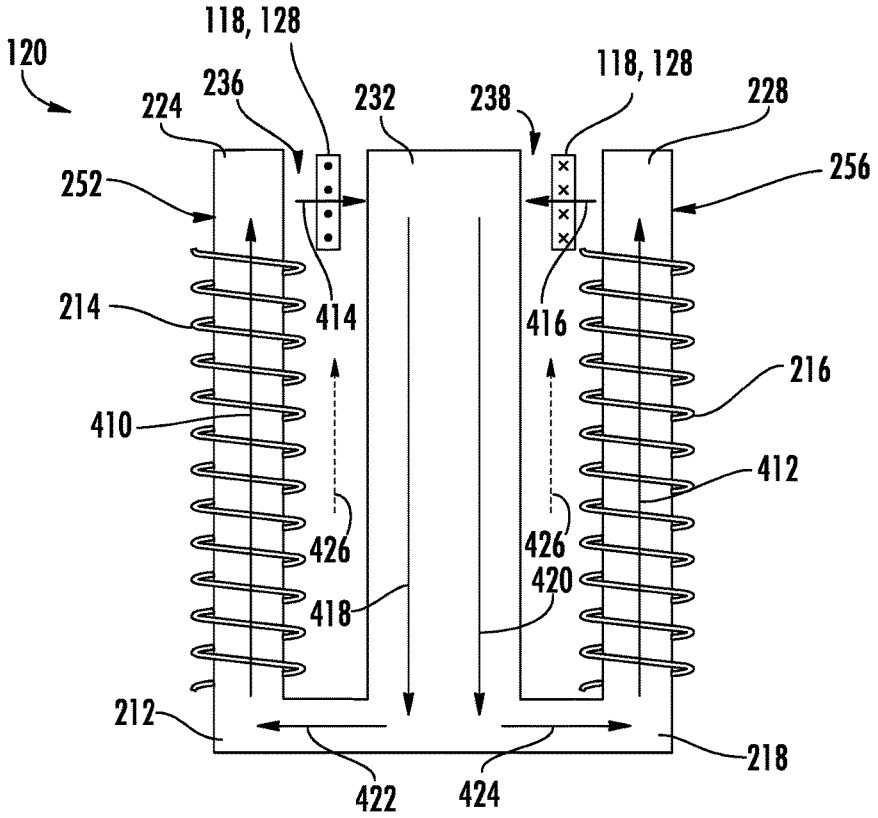
FIG. 4 is a partial cross-sectional view of the DC arc protection system of FIG. 2.

Referring now to FIG. 4, when the coils 214, 216 are energized, magnetic fields are produced in the core 212. The various arrows of FIG. 4 represent the general direction of travel of the magnetic fields produced by the coils 214, 216. Generally, the magnetic fields loop through the core 212 and across the gaps 236, 238 near the exposed sections 252, 256. As shown by arrows 410, 412 the magnet fields travel up their respective columns 224, 228 and into the exposed sections 252, 256. Arrows 414, 416 show the magnetic fields travelling across the gaps 236, 238 from the exposed sections 252, 256 of the columns 224, 228 to the central column 232. As the magnetic fields travel across the gaps 236, 238, the magnetic fields pass through the contact regions 310 defined by the prongs 128 and the supply terminals 118. As discussed above, the generated magnetic field reduces any DC arcing that might form between the prongs 128 and the supply terminals 118 in the contact region 310 as the prongs 128 and the supply terminals 118 are disconnected. As shown by the arrows 418, 420, 422, 424, the magnetic fields also looping through the central column 232 and the base 218.

As the magnetic fields pass through the first gap 236 and the second gap 238, a Lorenz force 426 is produced that pushes the arc current up and out of the electromagnet 120. In the illustrative embodiment, the current passing through the supply terminal 118/prong 128 positioned in the first gap 236 flows out of the plane of the page, as shown by the dots on the supply terminal 118/prong 128 in FIG. 4. The interaction between the current and the magnetic field in the first gap 236 (represented by arrow 414) creates an upward Lorenz force 426 in the first gap 236. Similarly, the current passing through the supply terminal 118/prong 128 positioned in the second gap 238 (as shown by the x's) cooperates with the magnetic field in the second gap 238 (represented by arrow 416) and creates another upward Lorenz force 426 in the second gap 238.

Figure 5:
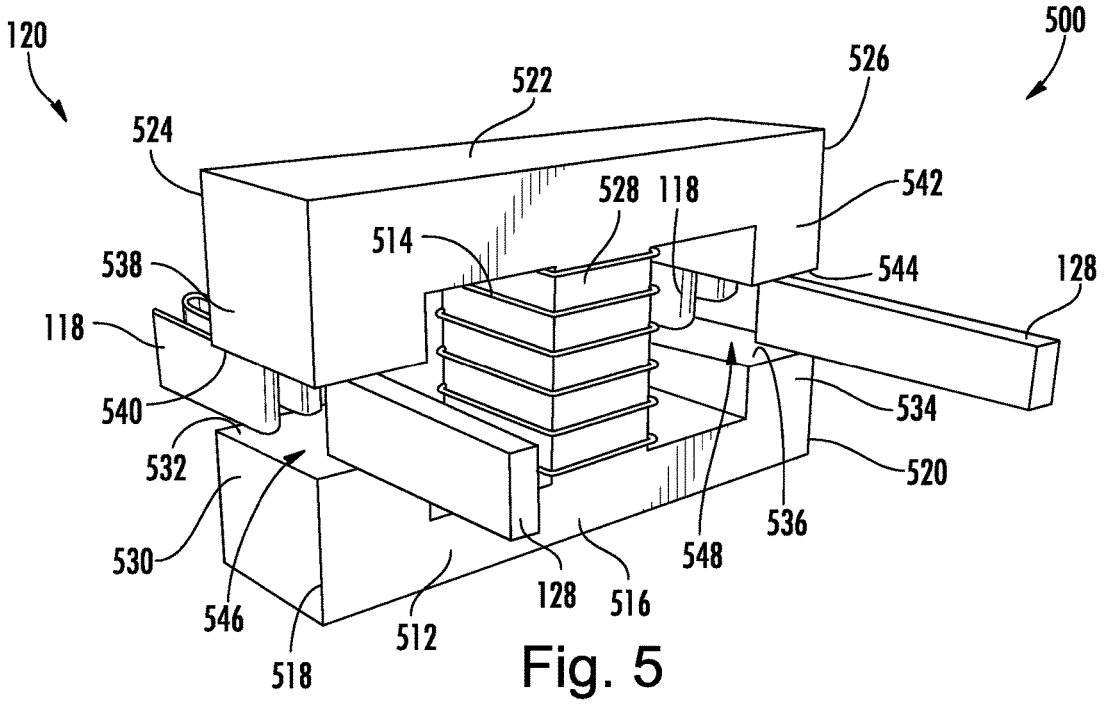
FIG. 5 is a perspective view of another embodiment of the DC arc protection system included in the DC socket of FIG. 1

Referring now to FIG. 5, another embodiment of a DC arc protection system 500 is shown. In the illustrative embodiment, the electromagnet 120 includes a core 512 made of a ferromagnetic material (such as iron) and a single coil 514 positioned on the core 512 configured to generate a magnetic field in response to a coil current. The core 512 includes a base 516 having a first end 518 and second end 520 and a top 522 having a first end 524 and a second end 526. A central column 528 is positioned between the first ends 518, 524 and the second ends 520, 526 and extends between the base 516 and the top 522. The base 516 includes a first base column 530 extending from the first end 518 of the base 516 towards the top 522 and ending in a first base gap surface 532. The base 516 also includes a second base column 534 extending from the second end 520 of the base 516 towards the top 522 and ending in a second base gap surface 536. The top 522 includes a first top column 538 extending from the first end 524 of the top 522 towards the base 516 and ending in a first top gap surface 540. The top 522 also includes a second top column 542 extending from the second end 526 of the top 522 towards the base 516 and ending in a second top gap surface 544. The columns 530, 534, 538, 542 are spaced apart from the central column 528. In the illustrative embodiment, the central column 528 is spaced evenly between the first columns 530, 538 and the second columns 534, 542.

The first base gap surface 532 and the first top gap surface 540 are spaced apart and define a first gap 546 sized to receive the supply terminals 118 and the prongs 128. Similarly, the second base gap surface 536 and the second top gap surface 544 are spaced apart and define a second gap 548 sized to receive the supply terminals 118 and the prongs 128. As such, the first and second gaps 546, 548 correspond to the contact region of the receptacle 116 in the illustrative embodiment of FIG. 5.

The coil 514 is positioned on the central column 528 and extends from the base 516 to the top 522. In the illustrative embodiment, the coil 514 is made of a conductive wire, such as copper wire, that is wound around the central column 528 to form a solenoid structure.

Figure 6:
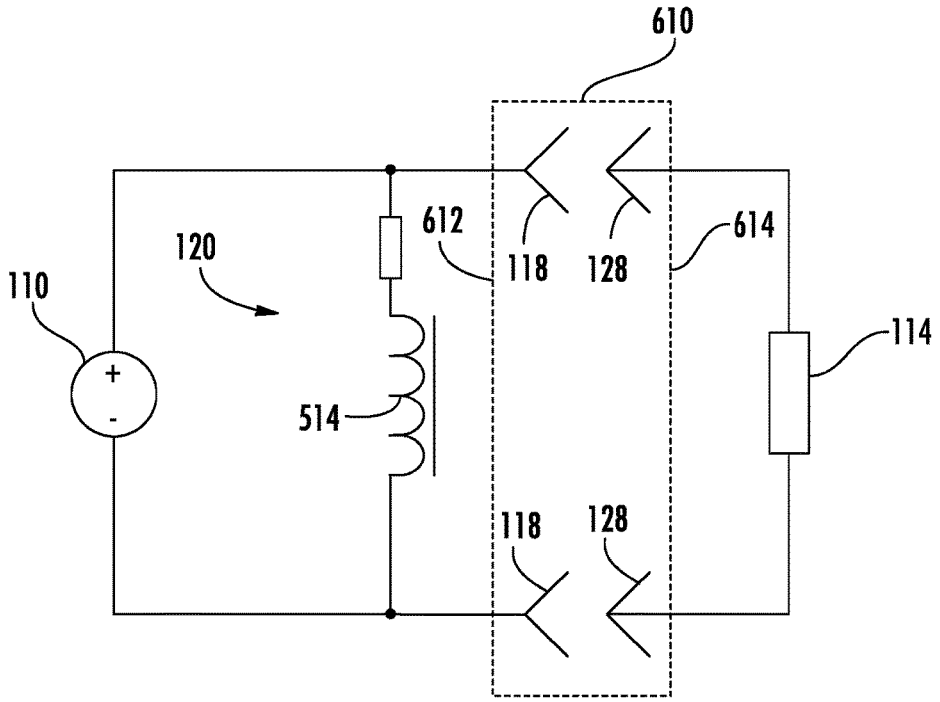
FIG. 6 is a simplified electrical circuit diagram of the DC arc protection system of FIG. 5.

Referring now to FIG. 6, the single coil 514 of the electromagnet 120 is connected in parallel with the DC power source 110, as well as the electrical device 114 when the electrical device 114 is connected to the receptacle 116. The electrical device 114 includes the two prongs 128 that are configured to mate with or otherwise contact the two corresponding supply terminals 118 in a contact region 610 of the receptacle 116. Because the coil 514 is coupled in parallel with the DC power source 110, the DC power source 110 supplies a constant current to the electromagnet 120 and the resulting magnetic field is time invariant. Thin gauge wires can be used to construct coil 514 such that the coil resistance is high enough to maintain low power consumption of the coil, and in the meanwhile to obtain sufficient magnetic field with large number of turns. As such, the electromagnet 120 of the DC arc protection system 500 will produce a stronger magnetic field with light load current conditions relative to the electromagnet 120 of the DC arc protection system 200.

In the illustrative embodiment, the coil 514 of the electromagnet 120 is connected in parallel with the DC power source 110 and the electrical device 114, when the electrical device 114 is connected to the DC socket 112. In some embodiments, the DC arc protection system 500 includes a sensor configured to generate sensor data indicative of when an electrical device 114 is connected to the DC power source 110 via the DC socket 112. When the sensor data indicates that an electrical device 114 is connected, the DC power source 110 will supply power to the coil 514 of the electromagnet 120 (e.g., via activation of a switch in series with the coil 514).

Figure 7:
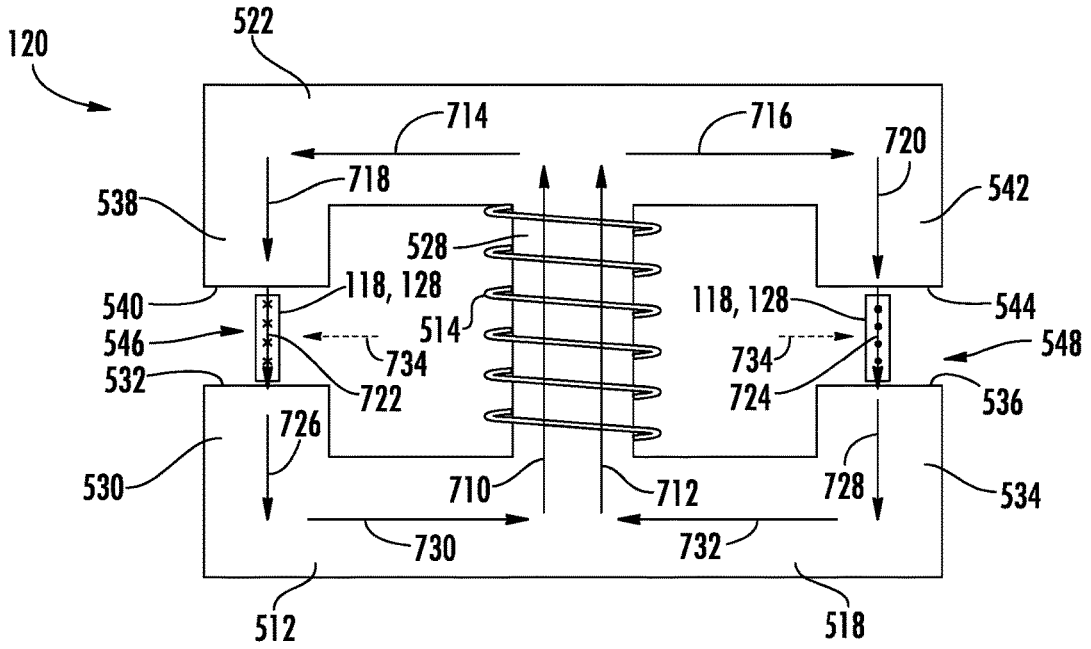
FIG. 7 is a partial cross-sectional view of the DC arc protection system of FIG. 5.

Referring now to FIG. 7, when the coil 514 is energized, magnetic fields are produced in the core 512 and the direction of travel of the magnetic fields is represented by the various arrows shown in FIG. 7. Arrows 710, 712, 714, 716, 718, 720 show the magnetic field being generated in the central column 528 by the coil 514, traveling along the top 522, and down both the first top column 538 and the second top column 542. Arrow 722 shows the magnetic field passing from the first top gap surface 540, into the first gap 546, through the electrical connectors 118, 128, and back into the core 512 through the first base gap surface 532. Arrow 724 shows a similar interaction involving the second columns 534, 542. Arrows 726, 728, 730, 732 show the magnetic field looping back through the base 516 of the core 512 and back to the central column 528. The core 512 is configured to guide the magnetic fields to the gaps 546, 548 thereby causing a greater magnetic flux to pass through the electrical connectors 118, 128 positioned in the gaps 546, 548. In general, the ferromagnetic material of the core 512 has a higher magnetic permeability than surrounding environment, causing most of the magnetic field generated by the coil 514 to be concentrated in the core 512. When the magnetic fields pass through the gaps 546, 548 (e.g., exiting the core 512 through the top gap surfaces 540, 544), the magnetic fields will spread out before curving back to enter the next piece of the core 512 (e.g., entering the core 512 through the base gap surfaces 532, 536). A similar phenomenon occurs between the exposed sections 252, 256 and the central column 232 of the embodiment 200 described above.

Similar to what was described above, as the magnetic fields pass through the first gap 546 and the second gap 548, a Lorenz force 734 is produced that pushes the arc current out of the electromagnet 120. In the illustrative embodiment, the current passing through the supply terminal 118/prong 128 positioned in the first gap 546 flows into the plane of the page, as shown by the x's on the supply terminal 118/prong 128 in FIG. 7. The interaction between the current and the magnetic field in the first gap 546 (represented by arrow 722) creates an outward Lorenz force 734 in the first gap 546. Similarly, the current passing through the supply terminal 118/prong 128 positioned in the second gap 548 (as shown by the dots) cooperates with the magnetic field in the second gap 548 (represented by arrow 724) and creates another outward Lorenz force 734 in the second gap 548.

Figure 8:
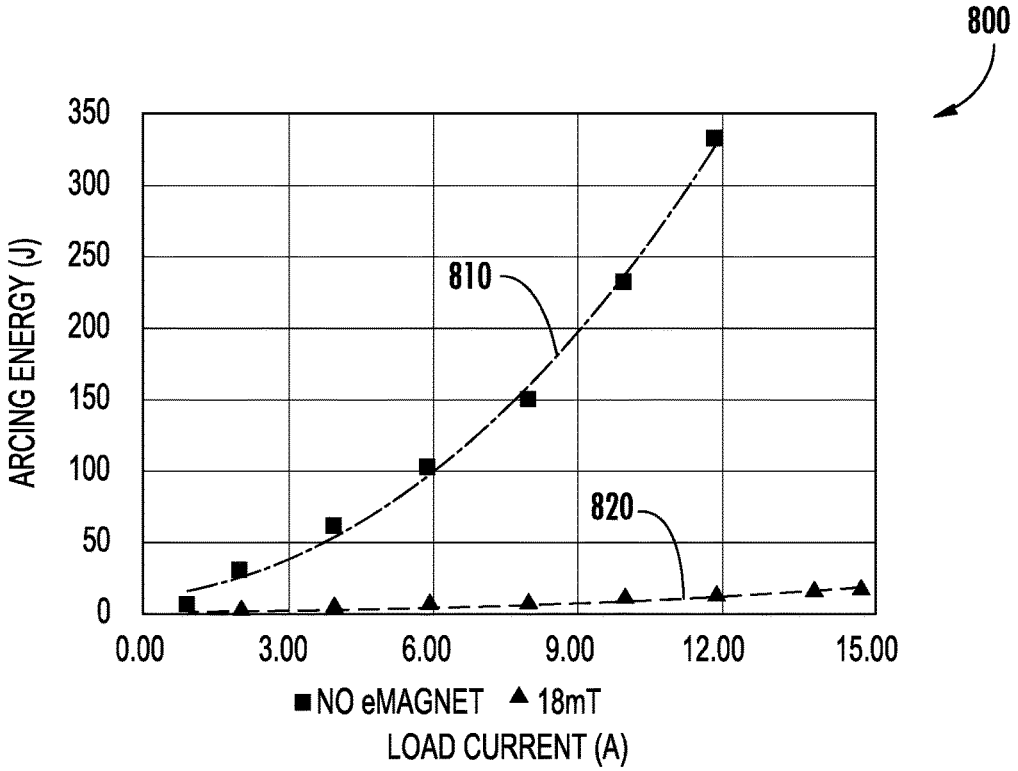
FIG. 8 is a simplified graph comparing illustrative results of measured DC arcing energy in DC sockets with the DC arc protection and DC sockets without the DC arc protection.
Figure 9:
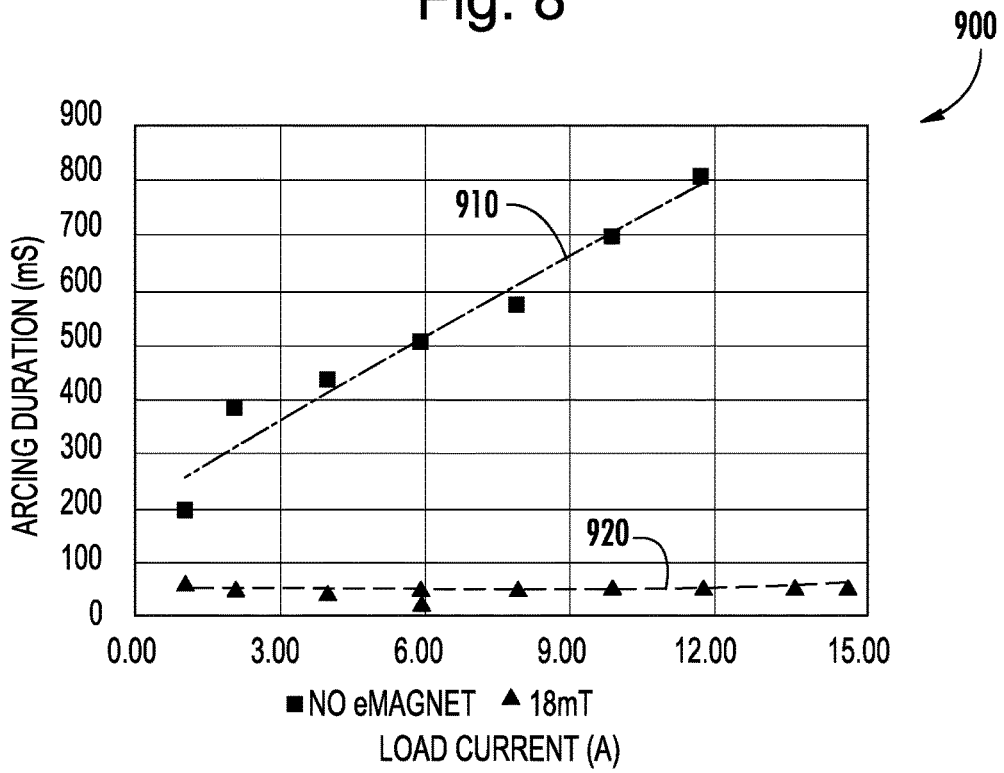
FIG. 9 is a simplified graph comparing illustrative results of measured DC arcing time duration in DC sockets with the DC arc protection and DC sockets without the DC arc protection.

Referring to FIGS. 8 and 9, graphs 800, 900 of illustrative measurements of the DC socket 112 relative to a typical DC socket (i.e., a socket without a DC arc protection system) are shown. In particular, graph 800 illustrates the arcing energy of a DC arc plotted against the load current delivered from the DC power source 110 to the electrical device 114. Plot 810 of graph 800 shows the energy in Joules of a DC arc formed as the prongs 128 are disconnected from the supply terminals 118 in a DC socket having no DC arc protection (i.e., having no electromagnet 120). Plot 820 of graph 800 shows the arc energy of a DC arc formed as the prongs 128 are disconnected from the supply terminals 118 in a DC socket 112 having an electromagnet 120 having a strength of about 18 millitesla (mT). As is shown by comparison of the plot 810 and the plot 820, generation of a magnetic field in the contact region of the DC socket 112 reduces the energy of a DC arc.

Graph 900 illustrates the arcing time duration of a DC arc plotted against the load current delivered from the DC power source 110 to the electrical device 114. Plot 910 of graph 900 shows the time duration in milliseconds (ms) of the DC arc formed as the prongs 128 are disconnected from the supply terminals 118 in a DC socket 112 having no DC arc protection (i.e., having no electromagnet 120). Plot 920 of graph 900 shows the time duration of a DC arc formed in a DC socket 112 having an electromagnet 120 having a strength of about 18 mT electromagnet. As is shown by comparison of the plot 910 and the plot 920, generation of a magnetic field in the contact region of the DC socket 112 reduces the time duration of the DC arc.

Figure 10:
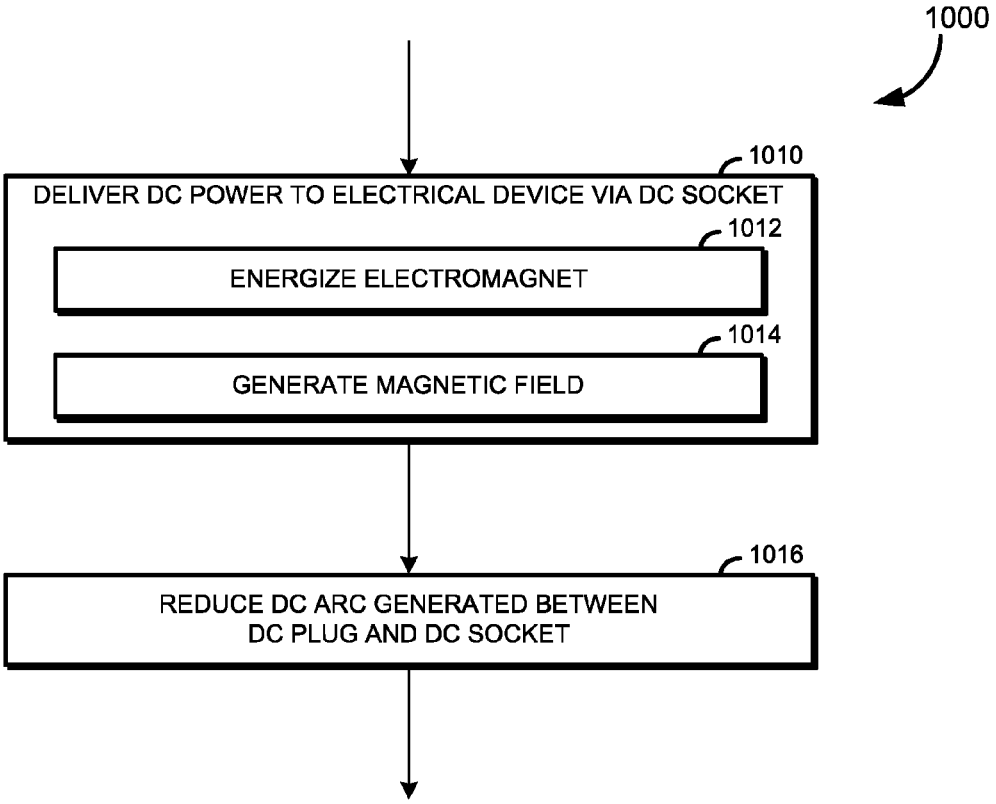
FIG. 10 is a simplified flow diagram of at least one embodiment of a method for reducing a DC arc between a DC socket and a DC plug.

Referring now to FIG. 10, in use, the illustrative DC socket 112 may perform a method 1000 for reducing DC arcing between the supply terminals 118 and the prongs 128 of the DC plug 126 of the electrical device 114. At block 1010, the DC socket 112 delivers DC power to the electric device 114 via electrical connections between a DC socket 112 and the DC plug 126. In general, the DC power is delivered to the electrical device 114 in response to a user of the electrical device 114 establishing an electrical connection between the electrical device 114 and the DC power source 110. For example, the user may establish the electrical connection by plugging the DC plug 126 into the DC socket 112. At block 1012, when power is delivered to the electrical device 114, the electromagnet 120 of the receptacle 116 of the DC socket 112 is energized. At block 1014, the energized electromagnet 120 generates a magnetic field within the contact region of the receptacle 116 of the DC socket 112. Subsequently, at block 1016, in response to the user disconnecting the DC plug 126 from the DC socket 112, the generated magnetic field reduces the energy and time duration of a DC arc formed in the DC socket 112 between the supply terminals 118 of the DC socket 112 and the prongs 128 of the DC plug 126. In some embodiments, such as the embodiment illustrated in FIGS. 2-4, the electromagnet 120 is energized with a load current supplied to the electrical device 114 by the DC power source 110 via the electrical connection established by the DC plug 126 and the DC socket 112. In such an embodiment, the electromagnet 120 generates a magnetic field proportional to the load current delivered to the electrical device 114. In other embodiments, such as the embodiment illustrated in FIGS. 5-7, the electromagnet 120 is energized based on a constant current and generates a time invariant magnetic field.

The invention claimed is:

1. A direct current (DC) socket for reducing DC arcing, the DC socket comprising:

a receptacle configured to receive one or more prongs of a DC plug of an electrical device, wherein the receptacle includes one or more supply terminals to supply a DC power from a DC power source to the electrical device via the DC plug, wherein each of the supply terminals is configured to contact a corresponding prong of the DC plug within a contact region of the receptacle while the DC plug is connected to the DC socket; and an electromagnet positioned in the receptacle and configured to produce a magnetic field within the contact region of the receptacle to reduce a DC arc generated between the supply terminals and the prongs in response to disconnection of the DC plug from the DC socket, the electromagnet comprising a core made of a ferromagnetic material and one or more coils positioned on the core configured to generate the magnetic field in response to a coil current;

wherein the core includes a base having a first end and a second end, a first column extending from the first end of the base, a second column extending from the second end of the base parallel to the first column; and a central column extending from the base parallel to the first column and the second column and positioned between the first column and the second column, wherein the first column and the central column define a first gap therebetween and the second column and the central column define a second gap therebetween.

2. The DC socket of claim 1, wherein the electromagnet is configured to produce the magnetic field in response to contact between the one or more prongs of the DC plug and the supply terminals of the receptacle.

3. The DC socket of claim 1, wherein the magnetic field produced by the electromagnet is proportional to a load current supplied to the electrical device by the DC socket.

4. The DC socket of claim 1 wherein the one or more coils comprise:

a first coil positioned on the first column around a first coil section of the first column and configured to generate a first magnetic field, wherein the first column includes a first exposed section above the first coil section configured to direct the first magnetic field across the first gap to the central column; and a second coil positioned on the second column around a second coil section of the second column and configured to generate a second magnetic field, wherein the second column includes a second exposed section above the second coil section configured to direct the second magnetic field across the second gap to the central column.

5. The DC socket of claim 4, wherein the first gap and the second gap are each sized to receive a supply terminal of the one or more supply terminals coupled to the corresponding prong of the DC plug.

6. The DC socket of claim 1, further comprising an arc chute positioned in the receptacle and configured to redirect the DC arc generated between the supply terminals and the prongs in response to disconnection of the DC plug from the DC socket.

7. The DC socket of claim 1, further comprising a shutter to selectively prevent access to the supply terminals.

8. A direct current (DC) socket for reducing DC arcing, the DC socket comprising:

a receptacle configured to receive one or more prongs of a DC plug of an electrical device, wherein the receptacle includes one or more supply terminals to supply a DC power from a DC power source to the electrical device via the DC plug, wherein each of the supply terminals is configured to contact a corresponding prong of the DC plug within a contact region of the receptacle while the DC plug is connected to the DC socket; and an electromagnet positioned in the receptacle and configured to produce a magnetic field within the contact region of the receptacle to reduce a DC arc generated between the supply terminals and the prongs in response to disconnection of the DC plug from the DC socket, the electromagnet comprising a core made of a ferromagnetic material and one or more coils positioned on the core configured to generate the magnetic field in response to a coil current;

wherein the core includes a base having a first base end a second base end, a top extending parallel to the base having a first top end a second top end, and a central column extending from the base to the top, wherein the central column connects the base to the top between the first and second ends of the base and the first and second ends of the top;

wherein the top includes a first top column extending toward the base at the first top end, and the base includes a first base column extending towards the top at the first base end; and wherein the top includes a second top column extending toward the base at the second top end, and the base includes a second base column extending toward the top at the second base end.

9. The DC socket of claim 8, wherein the one or more coils comprises a single coil configured to generate the magnetic field, wherein the single coil is positioned on the central column and extends from the base to the top.

10. The DC socket of claim 9, wherein the first top column and the first base column cooperate to define a first gap and the second top column and the second base column cooperate to define a second gap.

11. The DC socket of claim 10, wherein the first gap and the second gap are each sized to receive a supply terminal of the one or more supply terminals coupled to the corresponding prong of the DC plug.

12. The DC socket of claim 11, wherein the first top column and the first base column are configured to cause the magnetic field to pass from the first top column, across the first gap, to the first base column, and wherein the second top column and the second base column are configured to cause the magnetic field to pass from the second top column, across the second gap, to the second base column.

13. The DC socket of claim 8, further comprising an arc chute positioned in the receptacle and configured to redirect the DC arc generated between the supply terminals and the prongs in response to disconnection of the DC plug from the DC socket.

14. The DC socket of claim 8, further comprising a shutter to selectively prevent access to the supply terminals.

15. A method for reducing direct current (DC) arcing of a DC socket, the method comprising:

delivering, by the DC socket, a DC power from a DC power source to a DC plug of an electrical device connected to the DC socket, wherein delivering the DC power comprises energizing at least one coil of an electromagnet of the DC socket to generate a magnetic field within the DC socket, the at least one coil of the electromagnet being electrically coupled with the DC power source, and reducing, by the generated magnetic field, a DC arc generated within a receptacle of the DC socket in response to disconnection of the DC plug from the DC socket.

16. The method of claim 15, wherein energizing the at least one coil of the electromagnet comprises energizing the at least one coil with a load current supplied to the electrical device by the DC power source via the DC plug and the DC socket, wherein the electromagnet generates the magnetic field proportional to the load current delivered to the electrical device.

17. The method of claim 15, wherein reducing the DC arc within the receptacle of the DC socket includes reducing an energy of the DC arc and reducing a time duration of the DC arc.

18. The method of claim 15, wherein energizing the at least one coil of the electromagnet of the DC socket comprises energizing the electromagnet of the DC socket to generate a time invariant magnetic field.

19. The method of claim 15, wherein the at least one coil of the electromagnet is electrically coupled in parallel with the DC power source.

20. The method of claim 15, wherein the at least one coil of the electromagnet is electrically coupled in series with the electrical device.

21. The method of claim 15, wherein the electromagnet of the DC socket comprises a core having a base, a pair of outer columns extending from the base and a central column extending from the base between the outer columns, and wherein the at least one coil of the electromagnet is wrapped around one of the central column or one of the pair of outer columns.

* * * * *